US005131168A

United States Patent [19]

Rilke et al.

[11] Patent Number: 5,131,168

[45] Date of Patent: Jul. 21, 1992

[54] PROCEDURE AND APPARATUS FOR FREEZING A PRODUCT TO BE SUBJECTED TO FREEZE-DRYING

[75] Inventors: Rainer Rilke; Manfred Steiner, both of Köln, Fed. Rep. of Germany

[73] Assignee: Finn-Aqua Santasalo-Sohlberg GmbH, Hürth, Fed. Rep. of Germany

[21] Appl. No.: 638,890

[22] Filed: Jan. 8, 1991

[30] Foreign Application Priority Data

Jan. 15, 1990 [DE] Fed. Rep. of Germany ..... 4000913

[51] Int. Cl.[5] ..... F26B 5/06

[52] U.S. Cl. ..... 34/5; 34/17; 34/60; 34/92; 62/100; 62/268

[58] Field of Search ..... 34/5, 15, 92, 17, 60; 62/100, 268

[56] References Cited

U.S. PATENT DOCUMENTS

| | | | |
|---|---|---|---|
| 1,418,638 | 6/1922 | Frankel et al. | 34/92 |
| 2,345,548 | 3/1944 | Flosdorf et al. | 34/92 |
| 3,077,036 | 2/1963 | Neumann | 34/5 |
| 3,192,643 | 7/1965 | Rieutord | 34/92 |
| 3,382,586 | 5/1968 | Lorentzen | 34/92 |
| 3,648,379 | 3/1972 | Mercer et al. | 34/92 |
| 4,035,924 | 7/1977 | Faure | 34/5 |
| 4,449,305 | 5/1984 | Baron et al. | 34/92 |
| 4,780,964 | 11/1988 | Thompson, Sr. | 34/5 |

*Primary Examiner*—Henry A. Bennet
*Assistant Examiner*—Denise L. F. Gromada
*Attorney, Agent, or Firm*—Felfe & Lynch

[57] ABSTRACT

The product is frozen and freeze-dried in a freeze-drying apparatus (1) containing a freeze-drying chamber (2) with shelves (6) for performing the freeze-drying and a condenser (11), the cooling surfaces of which are formed by a coiled tube (14) in a number of tube coil turns (15), and where the low temperature created by the condenser (11) is used to freeze the product. To carry out the freezing quickly and simply the product is put into trays or dishes (21) and these trays or dishes are positioned on the tube turns (15) of the condenser (11) already in operation.

9 Claims, 1 Drawing Sheet

PROCEDURE AND APPARATUS FOR FREEZING A PRODUCT TO BE SUBJECTED TO FREEZE-DRYING

BACKGROUND OF THE INVENTION

The invention relates to a procedure for freezing a product that is to be subjected to the process of freeze-drying whereby the product is frozen and freeze-dried in a freeze-drying apparatus containing a freeze-drying chamber with shelves for performing the freeze-drying and a condenser with an evacuation pipe connection (for evacuating the freeze-drying chamber), the cooling surfaces of which are formed by a spiral tube in a number of tube coil layers, and where the coldness potential of the condenser is used to freeze the product. This invention also relates to a freeze-drying apparatus appropriate for carrying out said freeze-drying procedure.

Freeze-drying equipment of the type indicated here are known from the U.S. Pat. Nos. 3,077,036 and 4,035,924. The freeze-drying chambers are shown to have shelves where the product is placed during the drying process. For achieving the required vacuum and to precipitate the water vapor created during the drying process, condensers with pipe connections are provided which are located either inside the freezing chamber itself or in a separate chamber which is connected to the freezing chamber by piping and a closure valve. The cold surfaces of the condenser are commonly formed of spiral tubes in a circular tube coil array.

In the case of another freeze-drying apparatus of this type, the idea of using the coldness potential of the condenser to freeze the product that is to be freeze-dried has already been applied. In this case, the freeze-drying chamber is removably positioned on top of the condensation chamber. The axis of the spiral tube forming the cold surfaces of the condenser is vertically arranged. The process for freezing the product is provides that, initially, the freeze-drying chamber is removed from the condensation chamber. This way, the space of the spiral tube coil is accessible from the top. The container with the product to be freeze-dried is positioned in this space. A shortcoming is that there is no contact between the container and the spiral tube and that, therefore, the freezing process takes a relatively long time. Furthermore, the freezing procedure is rather complicated and can only be applied to relatively small product volumes. As a first step, the freeze-drying chamber has to be removed in order to place the product into the freezing chamber. Then the freeze-drying chamber is mounted only to be removed again after completion of the freezing process in order to be able to remove the frozen product. Finally, the freeze-drying chamber has to be mounted again in order to be able to perform the actual freeze-drying process.

SUMMARY OF THE INVENTION

The objective of the present invention to specify a procedure of the initially described type and to create a freeze-drying apparatus for performing said procedure such that a more simple and shorter freezing procedure can be carried out.

Before carrying out the freezing process, the product filled into trays or dishes and placing these trays or dishes into the coil turns of the condenser already in operation. This measure ensures a direct contact between the coil turns of the condenser and the dishes placed on top of them such that contact cooling can take place. This way, the freezing procedure is speeded up considerably, and lower temperatures can be achieved in the product. Furthermore, no external freezing equipment is required.

In a freeze-drying apparatus for performing the freeze-drying procedure in accordance with the present invention, this apparatus incorporating a condenser the cooling surfaces of which are formed by a number of coil turns of a coiled tube, to shape the coiled turn is sharp such that at least a number of the tube coil turns can be used to position trays or dishes with or without product containers. To form these shelves, the coil turns are designed that they are horizontal and are far enough apart from each other that the trays or dishes can be placed between the coils. If, in addition, at least a part of the condensation chamber is designed to be removable, then the coil shelves are easily accessible for placing down the trays or dishes with the product containers.

BRIEF DESCRIPTION OF THE DRAWING

Further advantages and details of the invention shall be explained using FIGS. 1 ,2 and 3 illustrating different design aspects.

DETAILED DESCRIPTION OF THE PREFERRED EMBODIMENT

Figure 1:
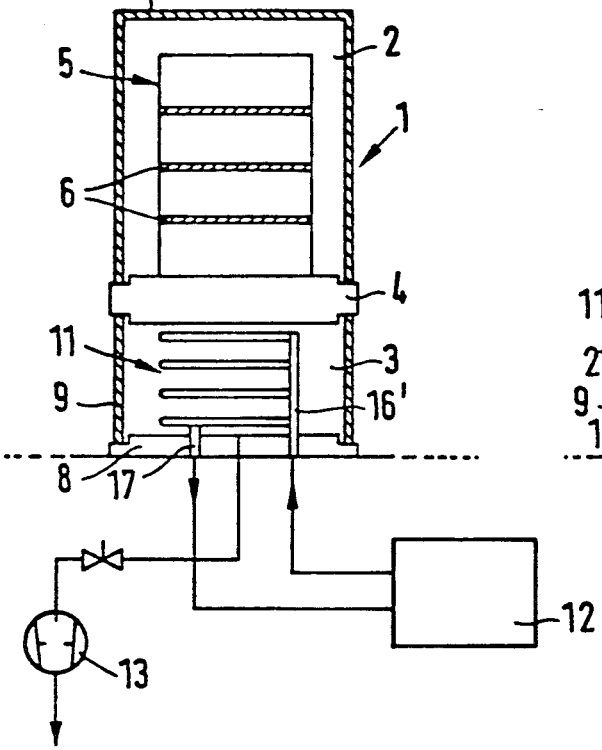
FIG. 1 shows a planar view of a freeze-drying apparatus designed in accordance with the present invention.

The freeze-drying apparatus 1 shown in FIG. 1 has a freeze-drying chamber 2 and a condensation chamber 3. Both are of cylindrical design, one being positioned on top of the other. The intermediate plate section 4 is both the cover plate of the condensation chamber 3 and the base plate of the freeze-drying chamber 2. Located within the intermediate plate section 4 are closable openings which allow joining the chambers 2 and 3 with each other; these closures are not shown in the drawing.

Located within the freeze-drying chamber 2 is a rack 5 with shelves 6. The chamber wall 7 is a cylindrical hood supported on the intermediate plate section 4 and preferably made from acrylic. The condensation chamber is made up of the intermediate plate section 4, of the base plate 8 and of the cylindrical body 9, the latter of which is also preferably made from acrylic glass. The condenser 11 is located inside the condensation chamber 3. The base plate 8 is positioned on top of a housing (not shown in FIG. 1) containing the schematically shown compressor 12 and the vacuum pump 13 for evacuating the condensation chamber 3.

The condenser 1 is formed by a spiral tube 14 with individual tube coil turn 15 which are designed such that they can be used to position the trays or dishes with or without individual product containers. The tube coil turn are, therefore, regularly designed to be a horizontal position. The tube, sections 16 connecting the individual coil turn 15 are positioned in a vertical line over each other to allow an essentially free access to the planes formed by the horizontal tube coil turns 15. The condenser is supplied through the vertical connecting pipes 16' and 17, whereby the coolant feed line 16 is connected to the topmost tube coil turn 15 and the coolant return line to the bottom most coil turn 15. The connecting pipes 16', 17 penetrate the base plate 8 and are the supporting elements of the condenser on this base plate 8 The connecting pipe 16', is covered by a sleeve 18 to prevent that the cold pipe 16 comes in direct contact with the base plate 8.

Figure 3:
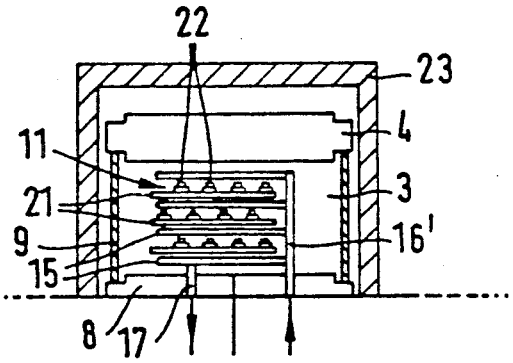
FIG. 3 shows a planar view of the condensation chamber.
Figure 2:
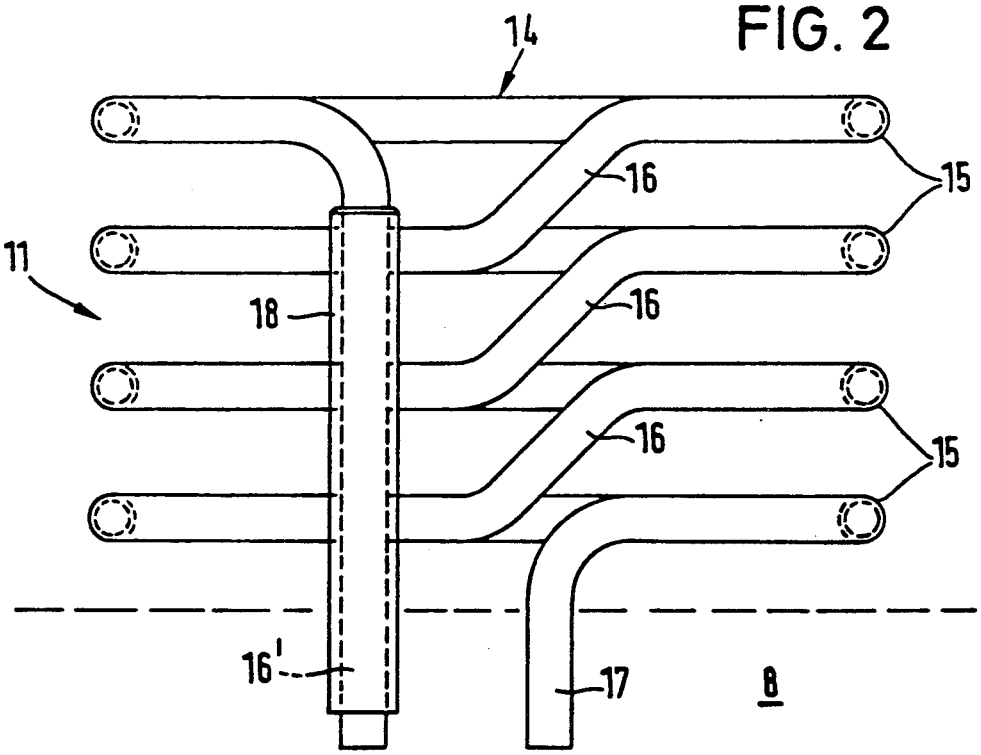
FIG. 2 shows a condenser tube coil designed in accordance with the present invention.

FIG. 3 shows the condensation chamber 3 during the freezing process. The trays or dishes 21 containing the product 22 to be frozen are positioned in the tube coils 15. Both the rack 5 and the cylindrical cover 7 of the freeze-drying chamber have been removed from the intermediate support plate 4. The condensation chamber 3 is covered by a hood 23 out of a heat insulation material, whereby the freezing process is speeded up and lower temperatures can be achieved. The trays or dishes 21 are charged into the tube coil turns 15 by lifting the cylinder 9 from the base plate 8. Of course, it is also possible to design the cylinder 9 to have a radial opening (not shown) that can be equipped with a vacuum-tight closure.

We claim:

1. Method of freeze drying a product in a freeze drying apparatus comprising a freeze drying chamber and a condensation chamber containing a condenser, said condenser having cooling surfaces formed by a coiled tube comprising a plurality of coil turns, said method comprising:

placing said product on trays, placing said trays on respective coil turns, said turns being designed to cooperate with said trays, freezing said product in said condensation chamber, and freeze-drying said product in said freeze-drying chamber.

2. Freeze drying apparatus comprising a plurality of trays for receiving product to be frozen, a condensation chamber containing a condenser having cooling surfaces formed by a coiled tube for passing coolant therethrough, said coiled tube comprising a plurality of coil turns horizontally arranged and connected by tube sections, said coil turns being designed to receive respective trays thereon, whereby said product may be frozen by placing on said trays and placing said trays on said coil turns, and a freeze drying chamber for freeze-drying said product after it is frozen.

3. Apparatus as in claim 2 wherein said tube sections are horizontally arranged in a vertical line essentially over each other to allow access to planes formed by the coil turns.

4. Apparatus as in claim 2 wherein at least part of said condensation chamber is removable to permit access to said coil turns.

5. Apparatus as in claim 2 wherein said condensation chamber has an opening over the height of the coil turns, said housing further comprising a vacuum tight closure for said opening.

6. Apparatus as in claim 2 wherein said condenser chamber comprises a cylindrical housing section and a base plate, said housing section being positioned in leak tight fashion on said base plate and being removable therefrom.

7. Apparatus as in claim 6 wherein said cylindrical housing section is translucent.

8. Apparatus as in claim 2 wherein said freeze drying chamber is removably positioned on said condensation chamber.

9. Apparatus as in claim 8 further comprising a heat insulating hood which is placed over said condensation chamber when said freeze-drying chamber is removed.

* * * * *

UNITED STATES PATENT AND TRADEMARK OFFICE

CERTIFICATE OF CORRECTION

PATENT NO. : 5,131,168

DATED : July 21, 1992

INVENTOR(S) : Rainer Rilke et al.

It is certified that error appears in the above-identified patent and that said Letters Patent is hereby corrected as shown below:

Column 2, line 58, delete "spiral" and insert --coiled--.

Column 2, line 59, delete "tube coil turn" and insert --coil turns--.

Column 2, line 61, delete "tube coil turn" and insert --coil turns--.

Column 3, line 1, delete "tube coil turn" and insert --coil turns--.

Column 3, line 17, delete "tube coil turn" and insert --coil turns--.

Signed and Sealed this

Eleventh Day of January, 1994

*Attest:*

*Attesting Officer*

BRUCE LEHMAN

*Commissioner of Patents and Trademarks*